US010248045B2

(12) United States Patent
Toyofuku

(10) Patent No.: US 10,248,045 B2
(45) Date of Patent: Apr. 2, 2019

(54) IMAGE FORMING APPARATUS WITH DEVELOPER FLUIDITY MEASUREMENT

(71) Applicant: Konica Minolta, Inc., Chiyoda-ku, Tokyo (JP)

(72) Inventor: Katsuya Toyofuku, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/901,344

(22) Filed: Feb. 21, 2018

(65) Prior Publication Data

US 2018/0239275 A1 Aug. 23, 2018

(30) Foreign Application Priority Data

Feb. 21, 2017 (JP) ..... 2017-030259

(51) Int. Cl.

*G03G 15/08* (2006.01)
*G03G 15/043* (2006.01)
*G03G 15/00* (2006.01)
*G03G 15/16* (2006.01)

(52) U.S. Cl.

CPC ..... *G03G 15/0848* (2013.01); *G03G 15/043* (2013.01); *G03G 15/1605* (2013.01); *G03G 15/5004* (2013.01); *G03G 2215/0607* (2013.01); *G03G 2215/1614* (2013.01)

(58) Field of Classification Search

CPC ..... G03G 15/0848
USPC ..... 399/49
See application file for complete search history.

(56) References Cited

U.S. PATENT DOCUMENTS 5,438,393 A * 8/1995 Komatsu ..... G01N 3/38 118/689
9,141,027 B1 9/2015 Furuki et al.
2006/0177235 A1* 8/2006 Itoyama ..... G03G 15/0848 399/63
2009/0257763 A1* 10/2009 Hayashi ..... G03G 15/0848 399/53

FOREIGN PATENT DOCUMENTS

JP 2010091725 A 4/2010
JP 2016004193 A 1/2016

* cited by examiner

*Primary Examiner* — Quana M Grainger
(74) *Attorney, Agent, or Firm* — Cantor Colburn LLP

(57) ABSTRACT

An object of the invention is to accurately grasp the fluidity of a developer and give proper feedback to an image forming process. An image forming device has a developing unit developing a latent image by transferring a developer to an image carrier, a fluidity measuring unit measuring fluidity of the developer, a correction amount computing unit computing a fluidity correction amount for correcting the fluidity of the developer measured by the fluidity measuring unit, and a process control unit changing a process condition of an image forming process. The process control unit selects, on the basis of the fluidity of the developer corrected based on the fluidity correction amount, an image forming process of changing a process condition from a plurality of image forming processes.

12 Claims, 8 Drawing Sheets

FIG. 5

| Standing time[h] | Temperature and humidity | Coverage | Fluidity correction amount[%] |
|---|---|---|---|
| 0～12 | LL | High | 20 |
| | | Intermediate | 20 |
| | | Low | 15 |
| | NN | High | 20 |
| | | Intermediate | 20 |
| | | Low | 15 |
| | HH | High | 15 |
| | | Intermediate | 15 |
| | | Low | 10 |
| 12～24 | LL | High | 20 |
| | | Intermediate | 20 |
| | | Low | 15 |
| | NN | High | 15 |
| | | Intermediate | 15 |
| | | Low | 10 |
| | HH | High | 10 |
| | | Intermediate | 10 |
| | | Low | 5 |
| 24～ | LL | High | 15 |
| | | Intermediate | 15 |
| | | Low | 10 |
| | NN | High | 5 |
| | | Intermediate | 0 |
| | | Low | 0 |
| | HH | High | 5 |
| | | Intermediate | 0 |
| | | Low | 0 |

IMAGE FORMING APPARATUS WITH DEVELOPER FLUIDITY MEASUREMENT

CROSS-REFERENCE TO RELATED APPLICATIONS

The present application claims priority under 35 U.S.C. § 119 to Japanese Application No. 2017-030259 filed Feb. 21, 2017, the entire content of which is incorporated herein by reference.

BACKGROUND

Technological Field

The present invention relates to an image forming device using a developer.

Description of the Related Art

Developers used for forming an image on a sheet in an image forming device include a one-component developer and a two-component developer. The two-component developer is constructed mainly by toner and carrier, and an external additive adheres to the surface of a toner particle.

The developer is made by various kinds of microparticles such as an external additive, and the performance of the developer easily changes according to a printing condition. When the performance of the developer changes and the fluidity of the developer deteriorates, the printing quality deteriorates. Consequently, the fluidity of the developer including the external additive has to be grasped accurately. For this purpose, for example, the following techniques are known.

Patent Literature 1 discloses a technique of measuring the amount of the external additive of a toner stemmed by a cleaning blade by a color discriminating sensor.

Patent Literature 2 discloses a technique of evaluating a toner layer state on a development roller, measuring the fluidity of the toner by a rotor method, and evaluating the fluidity.

CITATION LIST

Patent Literature

[Patent Literature 1] Japanese Unexamined Patent Application Publication No. 2016-4193

[Patent Literature 2] Japanese Unexamined Patent Application Publication No. 2010-91725

SUMMARY

In Patent Literature 1, the technique of measuring an external additive amount by a color discriminating sensor is described. By the technique, however, the amount of an external additive which is colorless and transparent cannot be measured, and the fluidity of a developer cannot be accurately grasped.

In Patent Literature 2, the technique of using a conical roller method is disclosed. However, the state of an external additive cannot be evaluated, and the fluidity of a developer cannot be accurately grasped.

The present invention has been made in consideration of such circumstances and is directed to improve the printing quality by accurately grasping the fluidity of a developer and giving proper feedback to an image forming process.

To achieve at least one of the abovementioned objects, according to an aspect of the present invention, an image forming device reflecting one aspect of the present invention is an image forming device forming an image via a plurality of image forming processes, and including: a developing unit transferring a developer to an image carrier and developing a latent image, a fluidity measuring unit measuring fluidity of the developer, a correction amount computing unit computing a fluidity correction amount for correcting the fluidity of the developer measured by the fluidity measuring unit, and a process control unit changing a process condition of an image forming process. The process control unit selects, on the basis of the fluidity of the developer corrected based on the fluidity correction amount, an image forming process whose process condition is to be changed from a plurality of image forming processes.

BRIEF DESCRIPTION OF THE DRAWINGS

The advantages and features provided by one or more embodiments of the invention will become more fully understood from the detailed description given herein below and the appended drawings which are given by way of illustration only, and thus are not intended as a definition of the limits of the present invention.

FIG. 5 is a list illustrating the relations between printing environments and fluidity correction amounts of a developer according to the embodiment of the present invention.

DETAILED DESCRIPTION OF EMBODIMENTS

Figure 1:
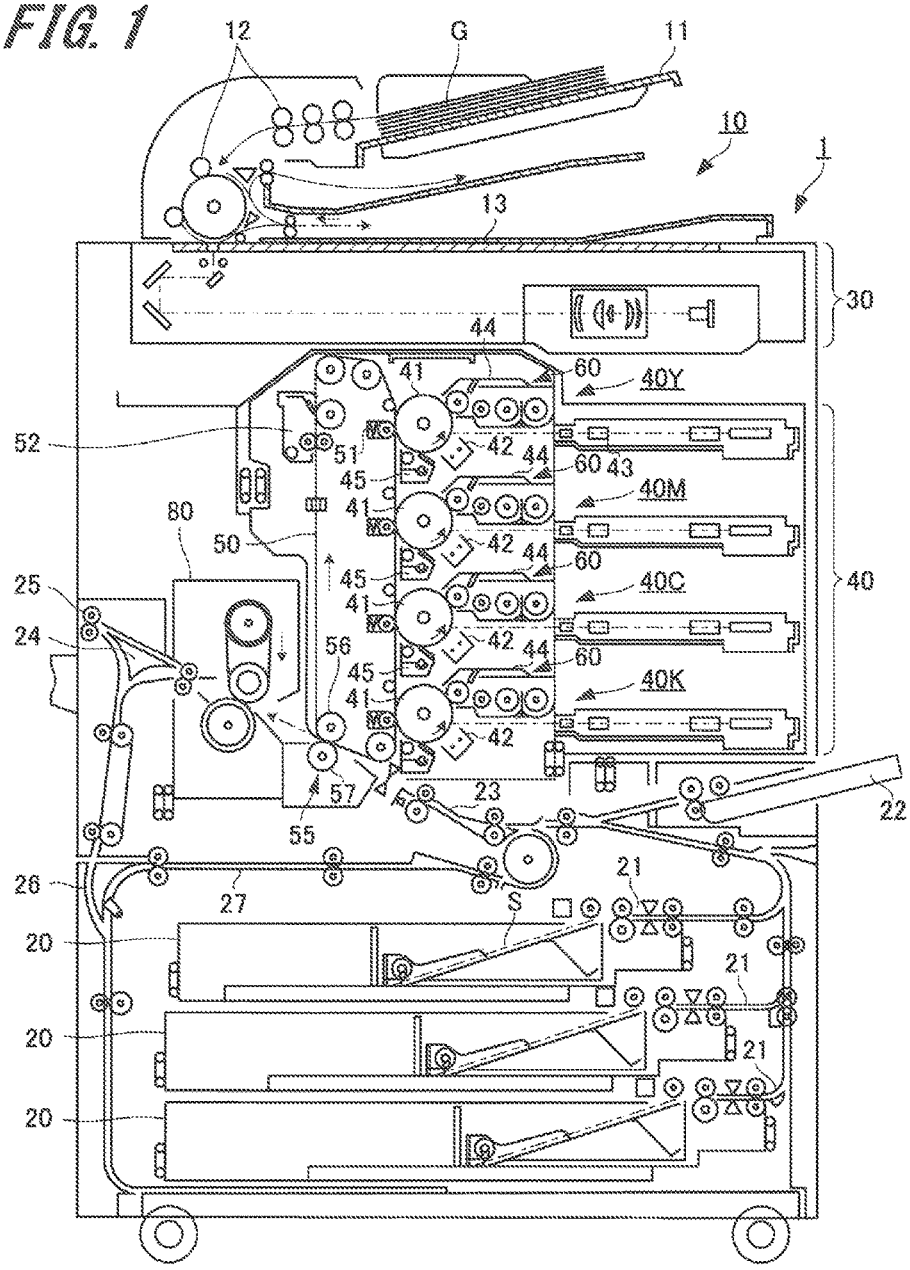
FIG. 1 is an explanatory diagram illustrating a configuration example of an image forming unit, an intermediate transfer belt, a secondary transfer unit, a fixing unit, and the like of an image forming device according to an embodiment of the present invention.

Hereinafter, embodiments for carrying out the present invention will be described with reference to the appended drawings. However, the scope of the invention is not limited to the disclosed embodiments. In the specification and the drawings, by designating the same reference numeral to components having substantially the same function or configuration, repetitive description will be omitted. Although a two-component developer made of toner and carrier is used as a developer in an embodiment, a one-component developer may be used.

FIG. 1 is an explanatory diagram illustrating a configuration example of an image forming unit 40, an intermediate transfer belt 50, a secondary transfer unit 55, a fixing unit 80, and the like of an image forming device 1 according to a first embodiment of the present invention.

The image forming device 1 forms an image on a sheet S by the electrophotographic system and is a color image forming device of a tandem type of superposing toners of four colors of yellow (Y), magenta (M), cyan (C), and black (Bk). The image forming device 1 has an original carrying unit 10, a sheet housing unit 20, an image reading unit 30, an image forming unit 40, the intermediate transfer belt 50, the secondary transfer unit 55, and the fixing unit 80.

The original carrying unit 10 has an original feeding stand 11 on which an original is set and a plurality of rollers 12. An original G which is set on the original feeding stand 11 of the original carrying unit 10 is carried one by one to the reading position of the image reading unit 30 by the plurality of rollers 12. The image reading unit 30 reads the original G carried by the original carrying unit 10 or an image of the original placed on an original stand 13 and generates an image signal.

A plurality of the sheet housing units 20 are disposed in a lower part of the device body and provided according to the sizes of the sheets S. The sheet S is fed by a feeding unit 21, sent to a carrying unit 23, and carried by the carrying unit 23 to the secondary transfer unit 55 as a transfer position. That is, the carrying unit 23 has the function of carrying the sheet S fed from the feeding unit 21 to the secondary transfer unit 55 and forms a carry path of carrying the sheet S. Near the sheet housing units 20, a manual feeding unit 22 is provided. From the manual feeding unit 22, a special sheet such as a sheet of a size which is not housed in the sheet housing units 20, a tag sheet having a tag, an OHP sheet or the like is transferred to the transfer position.

Between the image reading unit 30 and the sheet housing units 20, the image forming unit 40 and the intermediate transfer belt 50 are disposed. The image forming unit 40 has four image forming units 40Y, 40M, 40C, and 40K for forming toner images of the colors of yellow (Y), magenta (M), cyan (C), and black (Bk).

The first image forming unit 40Y forms a toner image of yellow, and the second image forming unit 40M forms a toner image of magenta. The third image forming unit 40C forms a toner image of cyan, and the fourth image forming unit 40K forms a toner image of black. Since the four image forming units 40Y, 40M, 40C, and 40K have the same configuration, the first image forming unit 40Y will be described here.

The first image forming unit 40Y has a drum-shaped photoreceptor 41 as an image carrier, and a charging unit 42 an exposing unit 43, a developing unit 44, and a cleaning unit 45 disposed around the photoreceptor 41. Each of the photoreceptors 41 rotates anticlockwise by a not-illustrated driving motor. The charging unit 42 applies charges to the photoreceptor 41 to uniformly charge the surface of the photoreceptor 41. The exposing unit 43 performs an exposure scan on the surface of the photoreceptor 41 on the basis of image data generated by the image reading unit 30, and forms an electrostatic latent image on the photoreceptor 41. By increasing exposure energy by increasing the exposure amount at the time of performing the exposure scan, a larger amount of toner can be moved from the developing unit 44 onto the photoreceptor 41.

Figure 3:
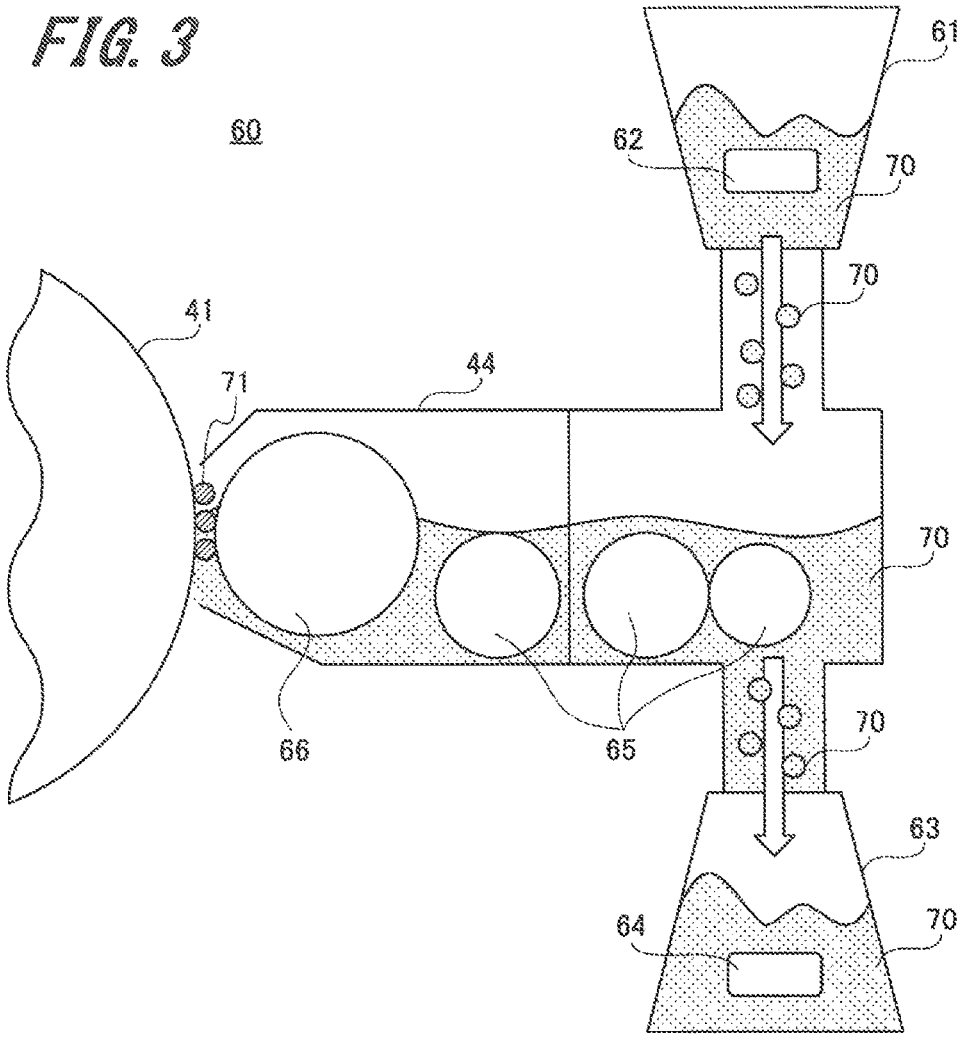
FIG. 3 is an explanatory diagram illustrating a configuration example of a trickle system according to the embodiment of the present invention.

By applying predetermined transfer current to a developer, the developing unit 44 makes the toner of yellow adhere to an electrostatic latent image formed on the photoreceptor 41 as an image carrier. It makes a toner image of yellow developed on the surface of the photoreceptor 41. The developing unit 44 of the second image forming unit 40M makes the toner of magenta adhere onto the photoreceptor 41, and the developing unit 44 of the third image forming unit 40C makes the toner of cyan adhere onto the photoreceptor 41. The developing unit 44 of the fourth image forming unit 40K makes the toner of black adhere onto the photoreceptor 41. In each of the developing units 44 of the four image forming units 40Y, 40M, 40C, and 40K according to the embodiment, as illustrated in FIG. 3 which will be described later, a trickle system 60 capable of replacing the developer in the developing unit 44 is constructed. Based on a fluidity measurement value of the developer, an amount of an external additive of the toner developed on the photoreceptor 41 is computed, and the state of the external additive is determined.

The toner adhering on the photoreceptor 41 is transformed onto the intermediate transfer belt 50 as an example of a belt-shaped image carrier and a toner image is developed on the intermediate transfer belt 50. The cleaning unit 45 removes the toner residing on the surface of the photoreceptor 41 after the image is transferred on the intermediate transfer belt 50.

The intermediate transfer belt 50 is formed in an endless state and rotates clockwise which is the direction opposite to the rotation direction of the photoreceptor 41 by a not-illustrated drive motor. Primary transfer units 51 are provided in positions opposed to the photoreceptors 41 of the image forming units 40Y, 40M, 40C, and 40K in the intermediate transfer belt 50. The primary transfer unit 51 transfers a toner image formed on the photoreceptor 41 onto the intermediate transfer belt 50 by applying the polarity opposite to that of the toner to the intermediate transfer belt 50.

When the intermediate transfer belt 50 rotates, toner images formed by the four image forming units 40Y, 40M, 40C, and 40K are sequentially transferred onto the surface of the intermediate transfer belt 50. By the operation, on the intermediate transfer belt 50, the toner images of yellow, magenta, cyan, and black are superimposed to form a color image.

The secondary transfer unit 55 is disposed near the intermediate transfer belt 50 and in the downstream of the carrying unit 23. The secondary transfer unit 55 is constructed by a pair of roller members 56 and 57. Each of the roller members 56 and 57 is constructed so that the rotational speed is variable. The roller member 56 presses the sheet S fed by the carrying unit 23 against the intermediate transfer belt 50 side. The secondary transfer unit 55 transfers the color image formed on the intermediate transfer belt 50 onto the sheet S sent by the carrying unit 23. After transferring the color image to the sheet S, the cleaning unit 52 removes residual toners on the surface of the intermediate transfer belt 50. On the ejection side of the sheet S in the secondary transfer unit 55, the fixing unit 80 is provided. The fixing unit 80 presses and heats the toner image transferred to the sheet S to fix the toner image to the sheet S.

On the downstream side of the fixing unit 80, a switching gate 24 is disposed. The switching gate 24 switches the conveyance path of the sheet S which passed through the fixing unit 80. That is, in the case of performing face-up ejection in one-side image formation, the switching gate 24 makes the sheet S go straight. By the operation, the sheet S is ejected by a pair of sheet ejection rollers 25. In the case of performing face-down ejection in one-side image formation and two-sided image formation, the switching gate 24 guides the sheet S downward.

In the case of performing face-down ejection, after the sheet S is guided downward by the switching gate 24, the sheet S is turned upside down and carried upward by a sheet inverting and conveying unit 26. By the operation, the sheet S is ejected by the pair of sheet ejection rollers 25. In the case of performing two-sided image formation, the sheet S is guided downward by the switching gate 24, inverted upside down by the sheet inverting and conveying unit 26, and sent again to the transfer position by a re-feeding path 27.

Figure 2:
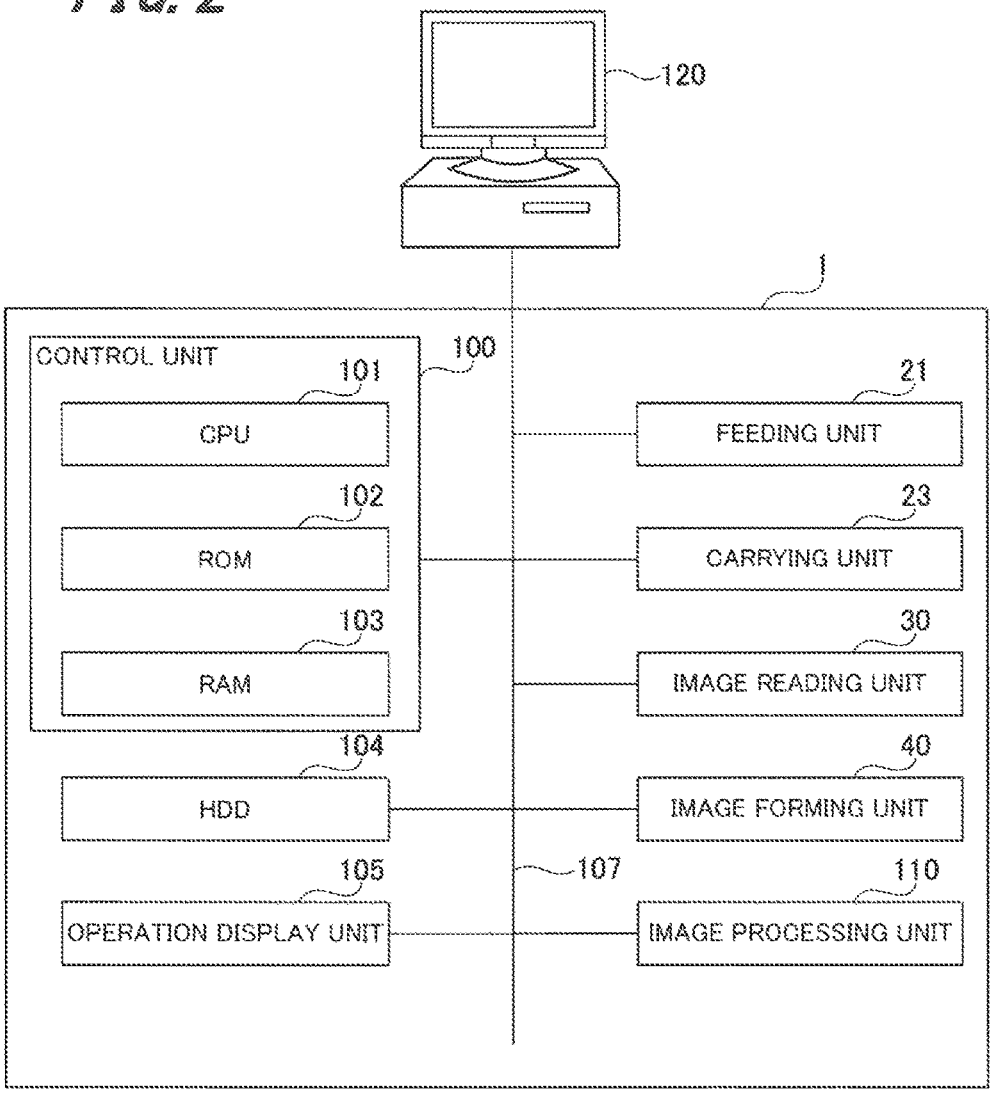
FIG. 2 is a block diagram illustrating a configuration example of a control system of the image forming device according to the embodiment of the present invention.

FIG. 2 is a block diagram illustrating a configuration example of a control system of the image forming device 1.

The image forming device 1 has, for example, a CPU (Central Processing Unit) 101, a ROM (Read Only Memory) 102 for storing a program or the like executed by the CPU 101, and a RAM (Random Access Memory) 103 used as a work region of the CPU 101. Further, the image forming device 1 has an HDD (Hard Disk Drive) 104 as a large-capacity storage device and an operation display unit 105. As the ROM 102, generally, an electrically erasable programmable ROM is used.

A control unit 100 of the image forming device 1 has the CPU 101, the ROM 102, and the RAM 103, is coupled to each of the HDD 104 and the operation display unit 105 via a system bus 107, and controls the entire device. The control unit 100 is also coupled to the feeding unit 21, the carrying unit 23, the image reading unit 30, the image forming unit 40, and an image processing unit 110 via the system bus 107.

The HDD 104 stores image data of an image in an original read and obtained by the image reading unit 30 and stores image data which is output or the like. The operation displaying unit 105 is a touch panel made by a display such as a liquid crystal display (LCD) or an organic ELD (Electro Luminescence Display). The operation displaying unit 105 displays information regarding an instruction menu to the user and image data obtained or the like. Further, the operation displaying unit 105 has a plurality of keys and receives inputs of data such as various instructions, characters, numerical values, and the like by key operations of the user.

The image reading unit 30 optically reads an image of an original and converts it to an electric signal. For example, in the case of reading a color original, image data having brightness information in which each of RGB is made by 10 bits per pixel is generated. The image data generated by the image reading unit 30 and image data transmitted from a PC (Personal Computer) 120 as an example of an external device coupled to the image forming device 1 is transmitted to the image processing unit 110 and subjected to image process. The image processing unit 110 performs, as necessary, the image process such as shading correction, image density adjustment, and image compression on the received image data.

For example, in the case of forming a color image by the image forming device 1, image data of R, G, and B generated by the image reading unit 30 or the like is supplied to a color conversion LUT (Look Up Table) in the image processing unit 110. The image processing unit 110 color-converts the RGB data to image data of Y, M, C, and Bk. On the color-converted image data, a screen process of dots with reference to a LUT of correction of tone reproduction characteristic and density correction, an edge process for emphasizing a fine line, or the like is performed.

Although the example of using the PC 120 as an external device has been described, the present invention is not limited to the example. As the external device, various devices such as a facsimile device can be used.

The image forming unit 40 receives the image data which is subjected to the image process by the image processing unit 110 and forms an image on the sheet S on the basis of the image data.

FIG. 3 is an explanatory diagram illustrating a configuration example of the trickle system 60.

The trickle system 60 is constructed in each of the developing units 44 of the colors of yellow (Y), magenta (M), cyan (C), and black (Bk), replenishes a developer 70 (an example of a two-component developer) to the developing unit 44, and discards the developer 70 used in the developing unit 44. A configuration example of the trickle system 60 constructed in the developing unit 44 of yellow (Y) will be described.

The trickle system 60 has, in addition to the above-described developing unit 40, a replenishing unit 61 provided upstream of the developing unit 44 and replenishing the developer 70 to the developing unit 44, and a discarding unit 63 provided downstream of the developing unit 44 and housing the developer 70 discarded from the developing unit 44. By attaching the replenishing unit 61 and the discarding unit 63 to the developing unit 44, the trickle system 60 capable of periodically replacing the developer 70 used in the developing unit 44 is constructed.

The replenishing unit 61 is provided with a replenished developer fluidity measuring unit 62 measuring the fluidity of the developer 70 housed in the replenishing unit 61. The discarding unit 63 is provided with a discarded developer fluidity measuring unit 64 measuring the fluidity of the developer 70 discarded from the developing unit 44.

The developer 70 is periodically added to the replenishing unit 61. Along the downward arrow, the developer 70 is replenished to the developing unit 44. The replenished developer fluidity measuring unit 62 measures the fluidity of the developer 70 housed in the replenishing unit 61. There is a case that only toner 71 is housed in the replenishing unit 61. In this case, the replenished developer fluidity measuring unit 62 measures the fluidity of the toner 71 housed in the replenishing unit 61 as an individual value of the toner 71.

In the developing unit 44, the developer 70 of a predetermined amount which is replenished from the replenishing unit 61 is housed. As described above, the developer 70 is made by the toner 71 and a not-illustrated carrier, and a toner image is developed by making the toner 71 adhere to the photoreceptor 41. The developing unit 44 is provided with a plurality of supply rollers 65 and a development roller 66. In the developer 70 in the developing unit 44, when the supply rollers 65 rotate, the toner 71 is friction-charged, and the carrier to which the toner 71 adheres moves towards the development roller 66. The developer 70 adheres to the development roller 66 to which high voltage is applied. To the carrier adhering to the development roller 66, the toner 71 charged to the polarity opposite to that of the carrier adheres. When development bias is applied to the development roller 66, the toner 71 is splashed from the development roller 66 to the photoreceptor 41, and a toner image is developed on the photoreceptor 41. By increasing the development bias of the developing unit 44, the amount of toner which can be moved to the photoreceptor 41 can be increased.

The carriers adhering to the development roller 66 are repeatedly used to splash the toner 71 to the photoreceptor 41. Consequently, the carrier repeatedly comes into contact with the toner 71 in the developing unit 44, is heated, and pressed, so that the surface of the carrier tends to be distorted. When the surface of the carrier is distorted, the toner 71 of the amount sufficient for the carrier does not adhere, and a toner image by the toner 71 of the sufficient amount is not developed on the photoreceptor 41. As a result, the printing quality deteriorates. Consequently, it is important to determine the state of the developer 70 used in the developing unit 44.

In the discarding unit 63, the developer 70 discarded from the developing unit 44 is housed. The developer 70 also moves along the downward arrow from the developing unit 44 to the discarding unit 63. The discarded developer fluidity measuring unit 64 measures the fluidity of the developer 70 housed in the discarding unit 63.

The replenished developer fluidity measuring unit 62 and the discarded developer fluidity measuring unit 64 determine the fluidity of the developers, for example, on the basis of the developer amount measured by the following first or second method.

As the first method, the amount of the developer 70 which travels a unit distance is measured by an optical sensor or a magnetic sensor. In the method, when the developer amount is large, it is determined that the fluidity of the developer 70 is high. When the developer amount is small, it is determined that the fluidity of the developer 70 is low.

As the second method, by a weight sensor, the weight of the developer 70 discharged from the developing unit 44 is measured and the amount of the developer is measured from the weight of the developer 70. In this method, when the weight of the developer 70 is large, it is determined that the fluidity of the developer 70 is high. When the weight of the developer 70 is small, it is determined that the fluidity of the developer 70 is low.

The fluidity of the developer 70 may be measured by a method other than the first and second methods.

Subsequently, for example, in consideration of the influence of the charge amount of the toner 71, the printing environment of the developer 70, the development bias applied to the photoreceptor 41, and the like exerted on the developer 70, the fluidity of the developer 70 measured by the replenished developer fluidity measuring unit 62 and the discarded developer fluidity measuring unit 64 is corrected.

Hereinafter, a method for correcting the fluidity of the developer 70 will be described.

Figure 4:
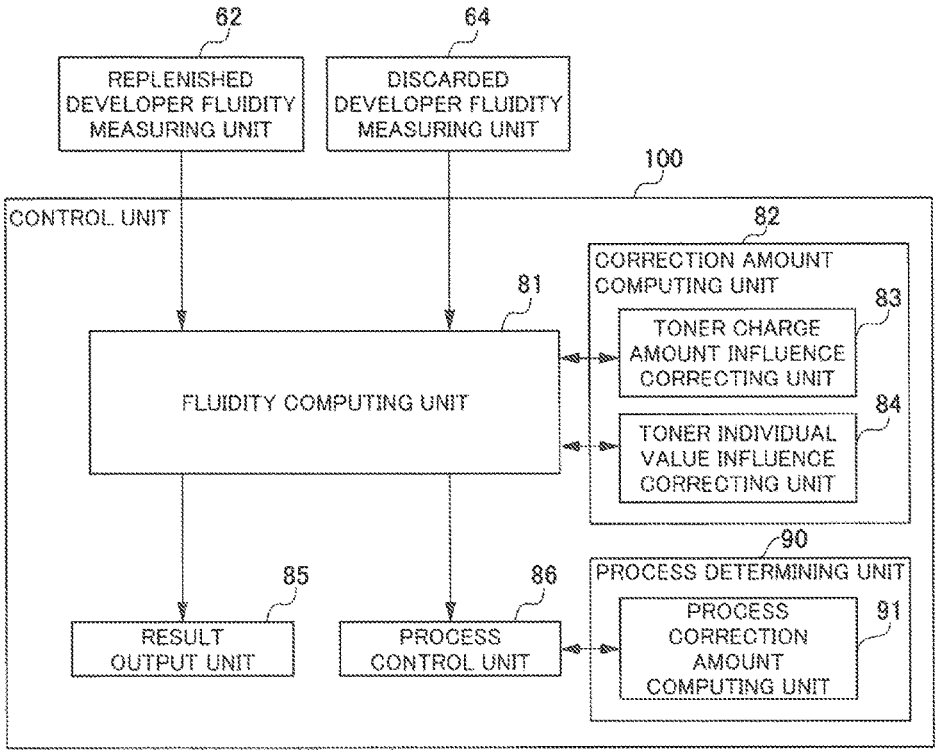
FIG. 4 is a block diagram illustrating an internal configuration example of a control unit according to the embodiment of the present invention.

FIG. 4 is a block diagram illustrating an internal configuration example of the control unit 100.

The control unit 100 has a fluidity computing unit 81, a correction amount computing unit 82, a result output unit 85, a process control unit 86, and a process determining unit 90.

The fluidity computing unit 81 corrects the fluidity of the developer 70 by a correction amount of the fluidity (herein below, also called "fluidity correction amount") of the developer 70. The fluidity correction amount is used to correct the influence on the fluidity of the developer 70 by the printing environment and the printing conditions. The fluidity computing unit 81 computes the fluidity correction amount of the developer 70 according to the printing environment of the developer 70 and, by the fluidity correction amount, corrects the fluidity of the developer 70 measured by the replenished developer fluidity measuring unit 62 and the discarded developer fluidity measuring unit 64.

The fluidity correction amount of the developer 70 is a value obtained by the correction amount computing unit 82. The correction amount computing unit 82 computes a fluidity correction amount according to the charging amount of the toner 71, the printing environment of the developer 70, the development bias applied to the photoreceptor 41, or the fluidity of the developer 70 housed in the replenishing unit 61 or the toner 71.

The relation between the fluidity of the developer and the fluidity correction amount can be said as follows.

For example, when coverage is low, only a slight amount of the toner 71 is used, so that residence time of the developer 70 in the developing unit 44 is long and the developer 70 tends to deteriorate. When the developer 70 deteriorates, charging of the toner 71 becomes more difficult. When the toner 71 is not easily charged, pulling between the carrier and the toner 71 is weak and the frictional resistance between the developer 70 becomes small, so that the fluidity of the developer 70 increases. In contrast, when coverage is high, a larger amount of the toner 71 is used, so that the residence time of the developer 70 in the developing unit 44 becomes shorter, and the developer 70 is also frequently replaced. Consequently, deterioration in the developer 70 is suppressed. When the developer 70 does not deteriorate, the toner 71 is easily charged. However, when the toner 71 is easily charged, the pulling between the carrier and the toner 71 is strong, and the frictional resistance between the developers 70 increases, so that the fluidity of the developer 70 decreases.

That is, when the fluidity of the developer 70 is low, the developer 70 is easily solidified, so that the fluidity correction amount increases. In contrast, when the fluidity of the developer 70 is high, the developer 70 is not easily solidified, so that the fluidity correction amount decreases.

Subsequently, referring to FIG. 5, a concrete method of obtaining a fluidity correction amount will be described.

FIG. 5 is a list illustrating relations between printing environments and fluidity correction amounts of the developer 70. The list has fields of the standing time, temperature and humidity, and coverage indicating printing environments, and the field of the fluidity correction amount. This list indicates the fluidity correction amount of the developer 70 for the printing environments (standing time, temperature and humidity, and coverage of the developer 70) which change the charging amount of the toner 71.

The standing time illustrated in FIG. 5 expresses time in which, for example, the power supply of the image forming device 1 is turned off and the developing unit 44 is not driven. As the standing time, 0 to 12 hours, 12 to 24 hours, and 24 hours or longer are specified. The standing time of zero refers to time immediately after the power supply of the image forming device 1 is turned off. "0 to 12 hours" indicates time equal to or longer than 0 and less than 12 hours, and "12 to 24 hours" indicates time equal to or longer than 12 hours and less than 24 hours.

The "temperature and humidity" indicates temperature and humidity in the room in which the image forming device 1 is installed or on the inside of the image forming device 1. For example, HH expresses that temperature is 30° C. and humidity is 80%, NN expresses that the temperature is 20° C. and humidity is 50%, and LL expresses that temperature is 10° C. and humidity is 10%.

The coverage is an index used as an example of the printing condition and expresses, for example, the use amount (%) of the toner 71 used per sheet of A4 size. When an entire A4 sheet is colored in black, the coverage of the toner 71 of black is 100%. When black is not used for the entire A4 sheet and the sheet is blank, the coverage of the toner 71 of black is 0%.

As expressed in the list of FIG. 5, the fluidity correction amounts corresponding to the high, intermediate, and low of the coverage when the standing time is 0 to 12 hours and the temperature and humidity is LL and NN are 20%, 20%, and 15%, respectively. From the list, when the standing time is short, the state where the toner 71 is charged is easily maintained, and the fluidity correction amount of the developer 70 has to be increased.

The fluidity correction amounts corresponding to the high, intermediate, and low of the coverage when the standing time is 0 to 12 hours and the temperature and humidity is HH are 15%, 15%, and 10%, respectively. Consequently, when the temperature and humidity is HH, the toner 71 is less easily charged as compared with the case where the temperature and humidity is LL and NN, so that the fluidity correction amounts corresponding to the high, intermediate, and low of the coverage become smaller.

However, when the standing time is 24 hours or longer, the toner 71 is discharged, and the fluidity of the developer 70 is high. Consequently, as compared with the case that the standing time is 0 to 12 hours and 12 to 24 hours, the fluidity correction amounts corresponding to LL, NN, and HH of the humidity and temperature and high, intermediate, and low of the coverage are smaller. As described above, under the condition that the charge amount of the toner 71 is large, the fluidity correction amount is large. Under the condition that the charge amount of the toner 71 is small, the fluidity correction amount is small. When the coverage is high, the charge amount of the toner 71 becomes larger, so that the fluidity correction amount is increased. When the coverage is low, the charge amount of the toner 71 becomes smaller, so that the fluidity correction amount is decreased.

Figure 6:
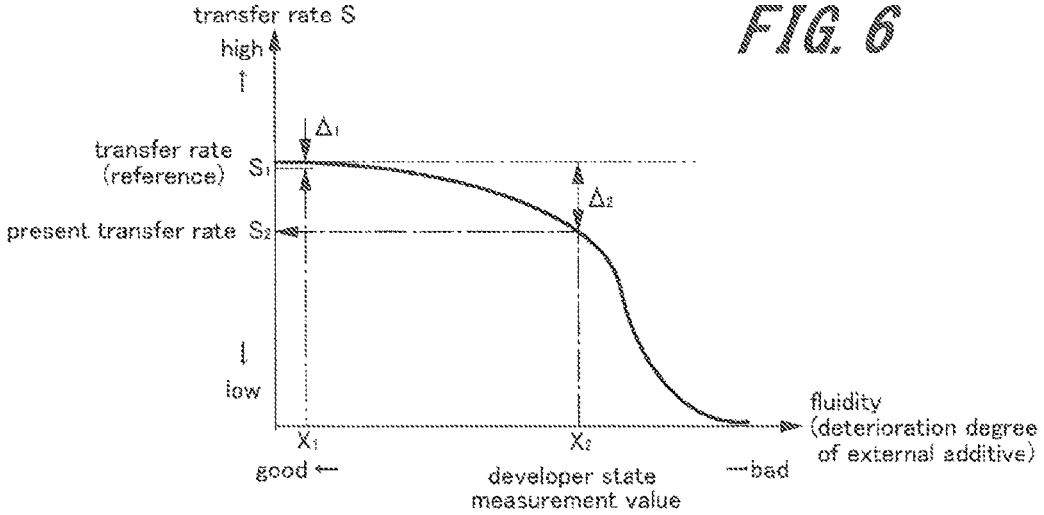
FIG. 6 is a graph illustrating the relation between the state of the developer and the transfer rate according to the embodiment of the present invention.
Figure 7:
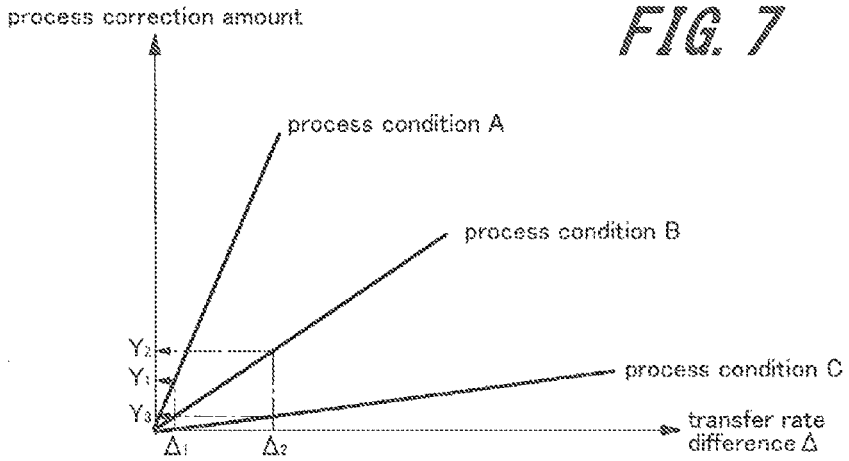
FIG. 7 is a graph illustrating the relations of correction amounts of process conditions and the transfer rate differences according to the embodiment of the present invention.
Figure 8:
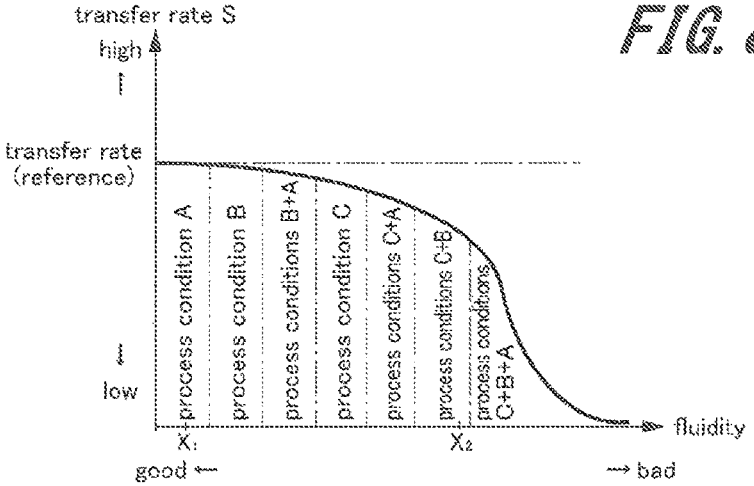
FIG. 8 is a graph illustrating the relation between the fluidity of the developer and a process condition to be selected according to the embodiment of the present invention.

With reference to FIG. 6 to FIG. 8, a change of the conditions of the image forming process performed on the basis of the fluidity of the developer corrected by the fluidity computing unit 81 will be described.

FIG. 6 is a correlation diagram illustrating the relation between the fluidity of the developer corrected by the fluidity computing unit 81 and the transfer rate. The horizontal axis of FIG. 6 indicates the fluidity of the developer, and the vertical axis indicates the transfer rate. The transfer rate of the embodiment refers to, for example, transfer rate of the developer transferred from the developing unit onto the photoreceptor. Degree of deterioration may be set on the horizontal axis. When the transfer rate immediately after changing the developer to a new developer is set as a reference value, the difference from the reference value is set as a transfer rate difference Δ. As illustrated in FIG. 6, as the fluidity of the developer becomes worse, the transfer rate S deteriorates, and the transfer rate difference Δ increases. The gradient of the solid line in the correlation diagram of the embodiment is an example and fluctuates according to the installing condition of the image forming device or the like. In place of the correlation diagram, a table expressing the relation between the fluidity of the developer and the transfer rate may be used. For example, a table divided like that the transfer rate is 100% when the fluidity of the developer is 100 to 90% and the transfer rate is 90% when the fluidity of the developer is 90 to 80% is used.

FIG. 7 illustrates the relation between the process correction amount necessary at the time of changing the process condition of each of the image forming processes and the transfer rate difference Δ. The horizontal axis of FIG. 7 indicates the transfer rate difference Δ, and the vertical axis indicates the transfer rate. The solid line in FIG. 7 indicates the ratio of the process correction amount needed at the time of changing the process condition of each image forming process. The solid line having the largest gradient (process condition A) indicates transfer as an image forming process. The straight line having the second largest gradient (process condition B) indicates exposure as an image forming process. The solid line having the smallest gradient (process condition C) illustrates development as an image forming process.

FIG. 8 illustrates the relation between the fluidity of the developer corrected by the fluidity computing unit 81 and an image forming process of changing the process condition on the basis of the fluidity. In FIG. 8, the horizontal axis indicates the fluidity of the developer, and the vertical axis indicates the transfer rate. Regions each for selecting an image forming process which changes the process condition are provided at equal intervals along the horizontal axis. In the embodiment, regions of the process conditions A, B, B+A, C, C+A, C+B, and C+B+A are set in descending order of fluidity of the developer.

For example, in the case where the fluidity of the developer corrected by the fluidity computing unit 81 is high and the transfer rate difference Δ is small, by selecting the image forming process (transfer) of the process condition A in which the gradient is large and correction with high sensitivity can be performed, even when the transfer rate difference Δ is small, correction with high sensitivity can be performed.

When the fluidity of the developer slightly deteriorates and the transfer rate difference Δ becomes large, a case occurs that a correction cannot be performed by the correction of the process condition having large gradient and high sensitivity, so that the image forming process (exposure) of the process condition B having the smaller gradient is selected. Further, when the fluidity of the developer deteriorates and the transfer rate difference Δ becomes larger, a case occurs that only correction of the process condition of one image forming process becomes insufficient, so that the image forming process (transfer) of the process condition A is selected in addition to the image forming process of the process condition B.

As illustrated in FIG. 6, the state where the fluidity of the developer does not deteriorate so much is set as $X_1$ and the state where deterioration in the fluidity of the developer advances is set as $X_2$. The transfer rate in the case of $X_1$ is $S_1$, and the transfer rate difference Δ is $\Delta_1$. The transfer rate in the case of $X_2$ is $S_2$, and the transfer rate difference Δ is $\Delta_2$.

In the case where the fluidity of the developer is $X_1$, the image forming process of the process condition A is selected. In the case where the fluidity of the developer is $X_2$, the image forming process of the process conditions C+B is selected.

When the image forming process of the process condition A is selected, based on FIG. 7, the process correction amount $Y_1$ of the process condition A is obtained from the transfer rate difference $\Delta_1$. The process control unit 86 gives a feedback to the image forming process (transfer) of the process condition A and increases transfer current on the basis of the process correction amount $Y_1$, thereby increasing the amount of toner which moves onto the photoreceptor to correct the transfer rate difference $\Delta_1$.

On the other hand, when the image forming processes of the process conditions C and B are selected, based on FIG. 7, the process correction amount $Y_2$ of the process condition B and the process correction amount $Y_3$ of the process condition C are obtained from the transfer rate difference $\Delta_2$. The process control unit 86 gives a feedback to the image forming process (exposure) of the process condition B and increases the exposure amount on the basis of the process correction amount $Y_2$. At the same time, the process control unit 86 gives a feedback to the image forming process (development) of the process condition C, increases the development bias on the basis of the process correction amount $Y_3$, thereby increasing the amount of the developer which can be moved onto the photoreceptor to correct the transfer rate difference $\Delta_2$.

As described above, in the embodiment, the image forming process of calculating the magnitude of the transfer rate difference Δ on the basis of the fluidity of the developer and changing the process condition is selected. By calculating an optimum correction amount for the process condition of the selected image forming process, proper feedback is performed to each of the image forming processes, and the transfer rate can be corrected.

As described above, in the image forming device of the embodiment, when the fluidity of the developer is high and the transfer rate difference Δ is small, by changing a process condition (for example, transfer current) of high correction sensitivity which can directly change the transfer rate, the transfer rate can be corrected properly. When the fluidity of the developer deteriorates and the transfer rate difference Δ increases, by changing the process condition (for example, the exposure amount or the development bias) other than the process condition of high sensitivity, the transfer rate can be corrected properly.

As described above, in the image forming device of the embodiment, the image forming process of changing the process condition is selected according to the state of the fluidity of the developer, that is, the magnitude of the transfer rate difference Δ, and the process condition of the image forming process selected can be corrected with an optimum value. By the above, proper feedback to the image forming process is performed, and degradation of the image quality can be prevented.

In the embodiment, when the deterioration of the fluidity of the developer advances, by selecting the image forming process of changing the plurality of process conditions, more proper feedback can be performed.

Further, an image forming process to be selected, whose process condition is to be changed may be changed according to the external environment in which the image forming device is installed, a sheet which is used, travel distance of the photoreceptor, or the like. The combination of image forming processes for changing the process condition or the priority of the image forming process selected when the fluidity of the developer deteriorates may be changed.

The image forming process of giving feedback is not limited to electric one but may be mechanical one. For example, the speed difference is made by advancing or retarding the speed of any of transfer rollers made by a pair of roller members to increase the rubbing force between the rollers, so that the apparent transfer rate of the developer which is transferred to the transfer medium can be increased. In the case of changing the speed of the roller, the degree of stretch of an input image of a latent image formed on the image carrier is changed according to the speed of the transfer roller which carries the developer. Specifically, in the case of increasing the speed of the roller which carries the developer, the degree of stretch of the input image is increased. In the case of increasing the speed of the opposed roller, the degree of stretch of the input image is lowered.

Figure 9:
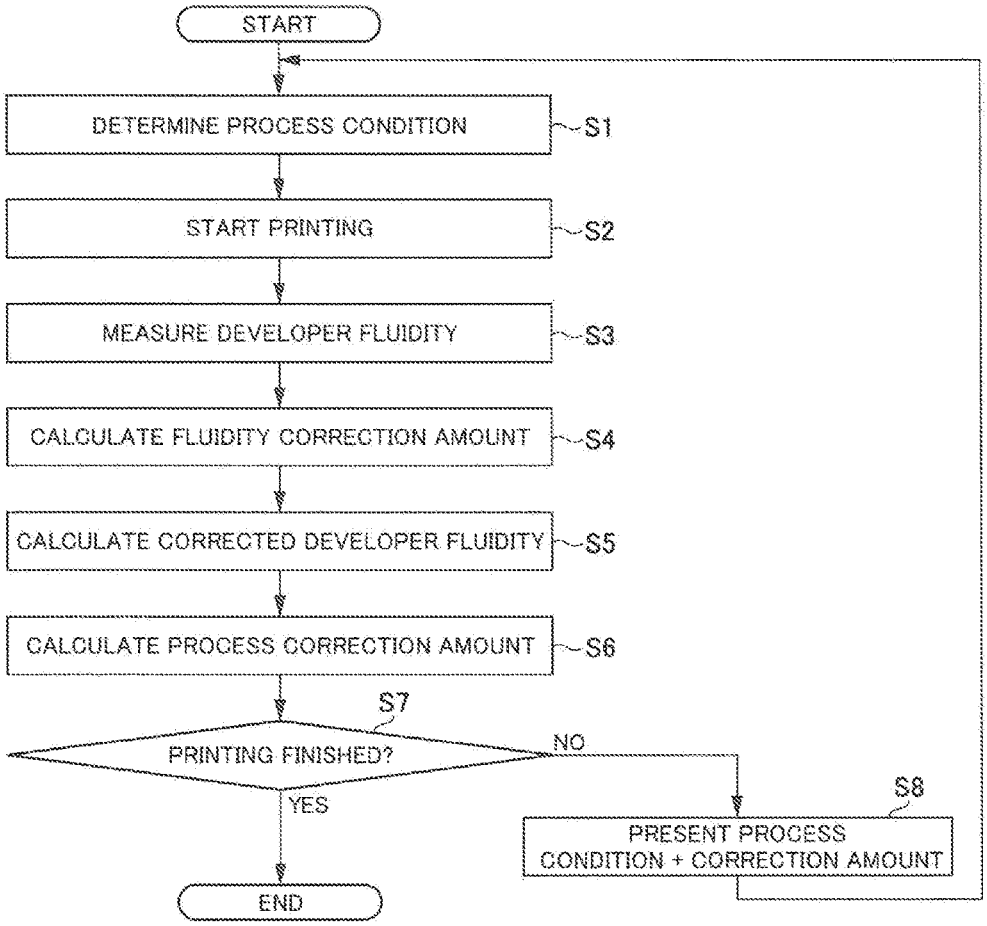
FIG. 9 is a flowchart illustrating an operation example of the control unit according to the embodiment of the present invention.

FIG. 9 is a flowchart illustrating an operation example of the control unit 100.

First, the process condition of each image forming process is determined on the basis of the printing condition or the like (S1). Subsequently, printing is started under the determined process condition (S2).

Next, the fluidity of the developer 70 is measured (S3). In the embodiment, the replenished developer fluidity measuring unit 62 measures the fluidity of the developer 70 housed in the replenishing unit 61, and the discarded developer fluidity measuring unit 64 measures the fluidity of the developer 70 housed in the discarding unit 63.

The correction amount computing unit 82 computes a fluidity correction amount on the basis of the charge amount of the toner 71, the printing environment of the developer 70, and the like (S4).

The fluidity computing unit 81 corrects the fluidity of the developer 70 on the basis of the fluidity correction amount computed by the correction amount computing unit 82 and calculates the fluidity of the developer 70 corrected (S5).

The process determining unit 90 selects, on the basis of the corrected fluidity of the developer 70, an image forming process whose process condition is to be changed, and a process correction amount computing unit 91 calculates a process correction amount related to the process condition of the image forming process selected by the process determining unit 90 (S6).

The control unit 11 determines whether printing is finished or not (S7) and, in the case of finishing the printing (Yes in S7), finishes the printing. In the case of continuing the printing (No in S7), the process control unit 86 changes the process condition of each of the image forming processes on the basis of the process correction amount calculated by the process correction amount computing unit 91 (S8).

As described above, in the embodiment, for example, by the fluidity correction amount corresponding to the charge amount of the toner 71 housed in the developing unit 44, the fluidity of the developer 70 is corrected. Consequently, as compared with the conventional methods, the fluidity of the developer can be grasped more accurately, and the process control unit 86 can give optimum feedback to each of the image forming processes on the basis of the corrected fluidity of the developer 70.

Although the changing of the process condition of each of the image forming processes on the basis of the corrected fluidity of the developer has been described in the foregoing embodiment, by calculating the external additive amount on the basis of the corrected fluidity of the developer, the process condition of each of the image forming processes may be changed.

Hereinafter, a method for computing the external additive amount from the fluidity of the developer 70 by the fluidity computing unit 81 will be described.

Figure 10:
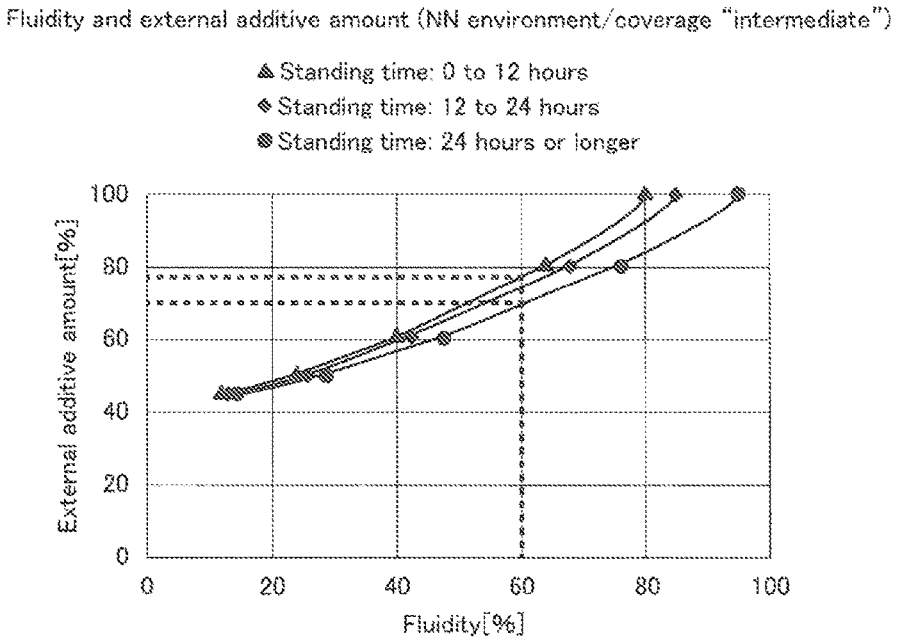
FIG. 10 is a graph illustrating the relation of the fluidity of the developer and the external additive amount which vary with standing time according to another embodiment of the present invention.

The fluidity computing unit 81 as an external additive computing unit obtains the fluidity correction amount on the basis of the list illustrated in FIG. 5 and, according to the fluid correction amount, calculates the external additive in accordance with the graph of FIG. 10.

FIG. 10 is a graph illustrating the relations of fluidity of the developer 70 and the external additive amount which vary with standing time. In this graph, the horizontal axis indicates the fluidity [%] of the developer 70 and the vertical axis indicates the external additive amount [%].

In FIG. 10, for example, the relation between the fluidity of the developer 70 and the external additive amount when the standing time is set to 0 to 12 hours, 12 to 24 hours, and 24 hours or longer in a state where the inside of the developing unit 44 is the environment of NN and the coverage is "intermediate". For example, when the external additive amount is 60%, it expresses that the external additive amount which was 100% at the time of manufacture of the developer 70 decreased to 60%.

As described above, when the fluidity of the developer 70 is close to 0%, the developer 70 does not easily flow. When the fluidity is close to 100%, the developer 70 flows very easily. When the external additive amount is close to 0%, the external additive is hardly included in the toner 71. When the external additive amount is close to 100%, the external additive of a sufficient amount is included in the toner 71. The external additive amount is calculated on the basis of the relation between the fluidity of the developer 70 and the external additive amount by the following equation (3). FIG. 10 is a graph expressed on the basis of the following equation (3). The equation (3) expresses that the external additive amount is obtained by excluding the influence by the toner charge amount from the fluidity measurement value of the developer 70.

$$\text{External additive amount} = a1 \times \exp(b1 \times \text{fluidity measurement value}) \quad (3)$$

a1 and b1 are values which fluctuate under each of the conditions.

As illustrated in FIG. 5, when the standing time is 0 to 12 hours, under the condition that the temperature and humidity is NN and the coverage is intermediate, the fluidity correction amount is 20%. When the standing time is 12 to 24 hours, the fluidity correction amount is 15%. In contrast, when the standing time is 24 hours or longer, the fluidity correction amount is 0%, so that it is unnecessary to correct the fluidity. When the printing conditions are the same as described above, the fluidity increases in order of the standing time 0 to 12 hours, 12 to 24 hours, and 24 hours or longer, and the fluidity correction amount also changes.

As illustrated in FIG. 10, for example, when the fluidity is about 60%, if the standing time is 0 to 12 hours, the external additive amount is about 75%. However, when the standing time is 24 hours or longer, the external additive amount decreases to about 70%. In such a manner, the fluidity computing unit 81 can accurately compute the external additive amount by applying the fluidity of the developer 70 corrected by the fluidity correction amount determined according to the printing environments including the standing time, temperature and humidity, and coverage into the equation (3).

Figure 11:
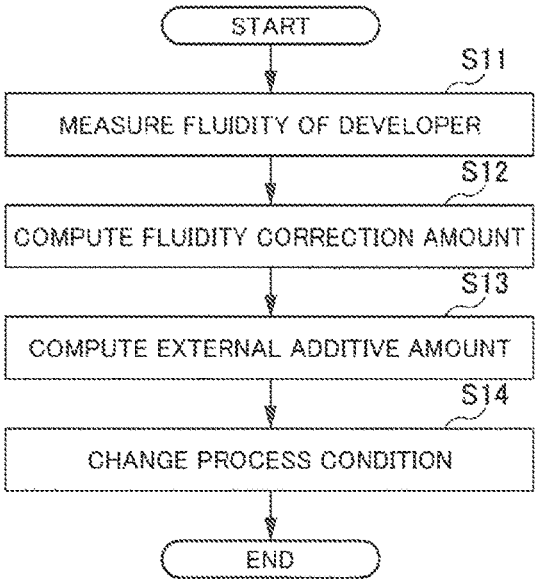
FIG. 11 is a flowchart illustrating an operation example of the control unit according to another embodiment of the present invention.

FIG. 11 is a flowchart illustrating an operation example of the control unit 100 of the embodiment.

First, the replenished developer fluidity measuring unit 62 measures the fluidity of the developer 70 housed in the replenishing unit 61, and the discarded developer fluidity measuring unit 64 measures the fluidity of the developer 70 housed in the discarding unit 63 (S11).

Next, the correction amount computing unit 82 computes the fluidity correction amount on the basis of the charge amount of the toner 71, the printing environments of the developer 70, and the like (S12).

The fluidity computing unit 81 corrects the fluidity of the developer 70 on the basis of the fluidity correction amount and computes the external additive amount from the fluidity of the developer 70 after correction, on the basis of the relation between the fluidity of the developer and the external additive amount illustrated in FIG. 10 (S13).

The process control unit 86 changes the process condition of each of the image forming processes on the basis of the external additive amount computed by the fluidity computing unit 81 (S14). The process correction amount of the process condition is calculated by, for example, using a correlation diagram obtained by replacing the horizontal axis of FIG. 6 to the degree of deterioration of the external additive. At this time, an external additive amount computation result may be output by the result output unit 85.

As described above, in the embodiment, the fluidity of the developer 70 is corrected by the fluidity correction amount, and the amount of the external additive of the toner 71 is computed from the corrected fluidity of the developer 70. Based on the amount of the external additive of the toner 71, the state of the external additive can be determined. Consequently, as compared with the method of predicting the external additive amount as a conventional method, the external additive amount can be computed more accurately. Therefore, the process control unit 86 can give proper feedback to the image forming process.

When a color discrimination sensor is used as in a conventional method, an external additive which is colorless cannot be measured. In contrast, in the embodiment, the fluidity computing unit 81 can obtain the amount of the external additive of the toner 71 from the fluidity of the developer 70. Consequently, regardless of the color of the external additive, the accurate external additive can be computed.

According to the present invention, by accurately measuring the fluidity of a developer, proper feedback can be given to an image forming process, and the printing quality can be improved. By accurately grasping the state of an external additive, the fluidity of the developer can be grasped more accurately.

Although embodiments of the present invention have been described and illustrated in detail, it is to be understood that the present invention is not limited to the foregoing embodiments but, obviously, can employ other applications and modifications as long as it does not depart from the gist of the present invention described in the scope of the claims for patent.

For example, in the foregoing embodiments, the configuration of the device and the system are specifically and concretely described to plainly explain the present invention, and the invention is not limited to a configuration having all of the components described. A part of the components of the embodiments described may be replaced with a component of another embodiment and, further, a component of another embodiment can be added to the configuration of any of the embodiments. With respect to a part of the components of each of the embodiments, another component may be added, deleted, or replaced.

The control lines and information lines which are considered to be necessary for description are illustrated and all of control lines and information lines in a product are not illustrated. It may be also considered that all of the components are mutually coupled in practice.

REFERENCE SIGNS LIST

1 image forming device
40 image forming unit
44 developing unit
60 trickle system
62 replenished developer fluidity measuring unit
63 discarding unit
64 discarded developer fluidity measuring unit
70 developer
71 toner
81 fluidity computing unit
82 correction amount computing unit
85 result output unit
86 process control unit

90 process determining unit

91 process correction amount computing unit

100 control unit

What is claimed is:

1. An image forming device forming an image via an image forming process using a developer, comprising:

a fluidity measuring unit measuring fluidity of the developer;

a process control unit selecting, on the basis of the fluidity, a process condition to be changed from a plurality of process conditions related to the image forming process, and changing the selected process condition;

a correction amount computing unit computing a fluidity correction amount for correcting the fluidity measured by the fluidity measuring unit, and correcting the fluidity on the basis of the fluidity correction amount;

wherein the process control unit selects, on the basis of the fluidity correction amount, the process condition to be changed.

2. The image forming device according to claim 1, wherein the correction amount computing unit computes the fluidity correction amount on the basis of the fluidity of the developer, or one or more process conditions related to the image forming process.

3. The image forming device according to claim 2, further comprising a developing unit transferring the developer to an image carrier and developing a latent image, wherein the developer is a two-component developer having toner and carrier, and the correction amount computing unit computes the fluidity correction amount on the basis of a charge amount of the toner, a printing environment of the developer, a development bias in the developing unit, or the fluidity of the toner.

4. The image forming device according to claim 1, further comprising a developing unit transferring the developer to an image carrier and developing a latent image, wherein the process condition to be changed, which is selected by the process control unit, includes at least any of a development bias in the developing unit, an exposure amount of an exposing unit exposing the surface of the image carrier, and a transfer current at the time of transferring the developer in the developing unit to the image carrier.

5. The image forming device according to claim 4, wherein the process control unit selects the process condition to be changed on the basis of a correlation between predetermined fluidity of the developer and a transfer rate of the developer to the image carrier.

6. The image forming device according to claim 4, wherein the process condition to be changed, which is selected by the process control unit, is speed of a pair of transfer rollers for transferring the developer on the image carrier to a recording medium.

7. The image forming device according to claim 6, wherein a condition of an input image for forming a latent image on the image carrier is changed according to the speed of the transfer rollers.

8. The image forming device according to claim 1, further comprising an external additive computing unit computing, on the basis of the fluidity correction amount, an amount of an external additive of the toner, and determining the state of the external additive, wherein the developer is a two-component developer having toner and carrier, and the process control unit selects the process to be changed on the basis of the state of the external additive determined by the external additive computing unit.

9. The image forming device according to claim 8, wherein the process control unit selects the process condition to be changed on the basis of a correlation between a state of a predetermined state of the external additive and a transfer rate of the toner to the image carrier.

10. The image forming device according to claim 1, wherein the process control unit selects one or more process conditions to be changed from a plurality of process conditions related to the image forming process.

11. The image forming device according to claim 1, wherein an image is formed via a plurality of image forming processes, and the process control unit selects a process condition to be changed from a plurality of process conditions related to one or more image forming processes.

12. An image forming device forming an image via an image forming process using a developer, comprising:

a fluidity measuring unit measuring fluidity of the developer;

a process control unit selecting, on the basis of the fluidity, a process condition to be changed from a plurality of process conditions related to the image forming process, and changing the selected process condition;

a developing unit transferring the developer to an image carrier and developing a latent image, wherein the process condition to be changed, which is selected by the process control unit, includes at least any of a development bias in the developing unit, an exposure amount of an exposing unit exposing the surface of the image carrier, and a transfer current at the time of transferring the developer in the developing unit to the image carrier;

wherein the process condition to be changed, which is selected by the process control unit, is speed of a pair of transfer rollers for transferring the developer on the image carrier to a recording medium; and wherein a condition of an input image for forming a latent image on the image carrier is changed according to the speed of the transfer rollers.

* * * * *